US011624203B2

(12) United States Patent
Mano

(10) Patent No.: US 11,624,203 B2
(45) Date of Patent: Apr. 11, 2023

(54) DEVICE FOR SECURING DEADBOLT LATCH

(71) Applicant: Harold Mano, Oakville (CA)

(72) Inventor: Harold Mano, Oakville (CA)

( * ) Notice: Subject to any disclaimer, the term of this patent is extended or adjusted under 35 U.S.C. 154(b) by 778 days.

(21) Appl. No.: 16/403,514

(22) Filed: May 4, 2019

(65) Prior Publication Data

US 2020/0347639 A1 Nov. 5, 2020

(51) Int. Cl.
*E05B 13/04* (2006.01)
*E05B 13/00* (2006.01)
*E05B 15/02* (2006.01)

(52) U.S. Cl.
CPC ..... *E05B 13/04* (2013.01); *E05B 13/002* (2013.01); *E05B 15/02* (2013.01)

(58) Field of Classification Search
CPC ..... E05B 13/00; E05B 13/002; E05B 13/04; E05B 15/02; Y10T 70/5155
USPC ..... 70/91; 292/288, 289, 296, 297
See application file for complete search history.

(56) References Cited

U.S. PATENT DOCUMENTS 152,058 A * 6/1874 Andrews ..... E05B 13/04 70/429
986,296 A * 3/1911 Kavanaugh ..... G08B 3/06 40/907
3,423,974 A * 1/1969 Bernsley ..... E05B 13/002 70/447
4,491,989 A * 1/1985 McGrail ..... A47K 13/10 4/246.1
4,639,147 A * 1/1987 Schwarz ..... A47K 13/12 114/144 R
4,884,421 A 12/1989 Lindsay
5,154,455 A * 10/1992 Awalt, Jr. ..... E05C 1/04 292/147
5,267,462 A * 12/1993 Pijanowski ..... B21D 1/12 72/392
5,313,812 A * 5/1994 Eklund ..... E05B 13/04 70/416
7,918,116 B2 4/2011 Quach
8,794,041 B2 8/2014 Daniels
9,663,969 B2 * 5/2017 Lila ..... E05C 19/12
2010/0156121 A1 * 6/2010 Badia ..... E05B 17/007 292/216

OTHER PUBLICATIONS

Flip Guard Mounting Card for Commercial Device, (C) 2017.
Four page printout of Hudson Lock LLC for Deadbolt Secure, Dec. 2, 2016.
https://www.youtube.com/watch?v-ld_lkCwld7o, Deadbolt Guard, Jul. 21, 2013.

* cited by examiner

*Primary Examiner* — Suzanne L Barrett

(57) ABSTRACT

Here is provided a device for securing a standard deadbolt lock in a locked orientation so that the deadbolt lock cannot be unlocked by an intruder. The device disclosed includes an elongated member pivotally coupled to a base member by a pivotal joint. The base member is securely mounted to a housing of the deadbolt lock and the protruding member has an elongated groove dimensioned and configured to receive the latch of the deadbolt lock and secure it within the groove such that the latch cannot be rotated to unlock the deadbolt lock. The protruding member is pivotally movable between a closed position wherein the latch is contained within the groove and an extended position wherein the protruding member is positioned away from the latch.

16 Claims, 7 Drawing Sheets

DEVICE FOR SECURING DEADBOLT LATCH

FIELD OF THE INVENTION

The invention relates generally to deadbolt latches for doors, and more particularly, to devices designed to secure the deadbolt latch in a secure position preventing the unauthorized unlocking of the deadbolt.

BACKGROUND OF THE INVENTION

Deadbolt locks are commonly used to secure doors against unwanted opening. The deadbolt lock generally comprises a lock housing, a bolt slidingly received in the lock housing, a latch rotatably mounted to the lock housing and movable between a locked position and an unlocked position, and a locking mechanism coupled to the latch and the bolt for moving the bolt between an extending position and a retracted position when the latch is moved between its locked and unlocked position, respectively. The deadbolt lock is always mounted to the door with the latch projecting from the inside surface of the door so that the person inside the property can control the operation of the deadbolt lock. To ensure that the door is locked, the operator would engage the latch and force it into its locked position. In this locked position the bolt is extended into the doorjamb and the door cannot be opened. Should the operator wish to unlock the door, all the operator need do is rotate the latch into its unlocked position which causes the bolt to retract into the lock housing. The deadbolt lock has a key face side which is always oriented to project from the outside surface of the door. A user wishing to unlock the deadbolt lock from the outside inserts a key into the keyhole in the key face and rotates the key to engage the lock mechanism to force the bolt into its retracted position which in turn causes the latch to rotate into its unlocked position. The operation of the bolt is effectively controlled by the key in the keyhole and the latch.

It will be appreciated that in some circumstances it may be possible for an intruder to unlock the deadbolt. If the intruder is provided with a counterfeit key, or if the intruder is adapt at picking locks, the intruder can force the bolt into its retracted position and gain entry into the residential property. In the event the operator becomes aware of such an unauthorized entry attempt into the residence, the operator can attempt to thwart the intruder's efforts by holding onto the latch of the deadbolt lock and firmly keeping the latch in its locked position. With the operator holding the latch in its locked position it will be very difficult if not impossible for the intruder to unlock the deadbolt lock. It is therefore advantageous to provide a device which aids the operator to keep the deadbolt latch in it's locked position by preventing the latch to be moved from its locked position.

SUMMARY OF THE INVENTION

In accordance with one aspect of the present invention, there is provided a device for securing a deadbolt lock in a locked orientation so that the deadbolt lock can't be unlocked by an intruder. The deadbolt lock which is the subject of the present invention has a lock housing, a bolt slidingly received in the lock housing, and a latch rotatably mounted to the lock housing. The latch is movable between a locked position and an unlocked position. The deadbolt lock also has a locking mechanism coupled to the latch and the bolt for moving the bolt between an extending position and a retracted position when the latch is moved between its locked and unlocked position. The device of the present invention includes an elongated member pivotally coupled to a base member by a pivotal joint. The base member is securely mounted to the lock housing and the protruding member has an elongated groove dimensioned and configured to receive the latch and secure it within the groove such that the latch cannot be rotated. The protruding member is pivotally movable between a closed position wherein the latch is contained within the groove and an extended position wherein the protruding member is positioned away from the latch. The protruding member is positioned relative to the latch such that the protruding member can be pivoted into its closed position when the latch is in its locked position.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
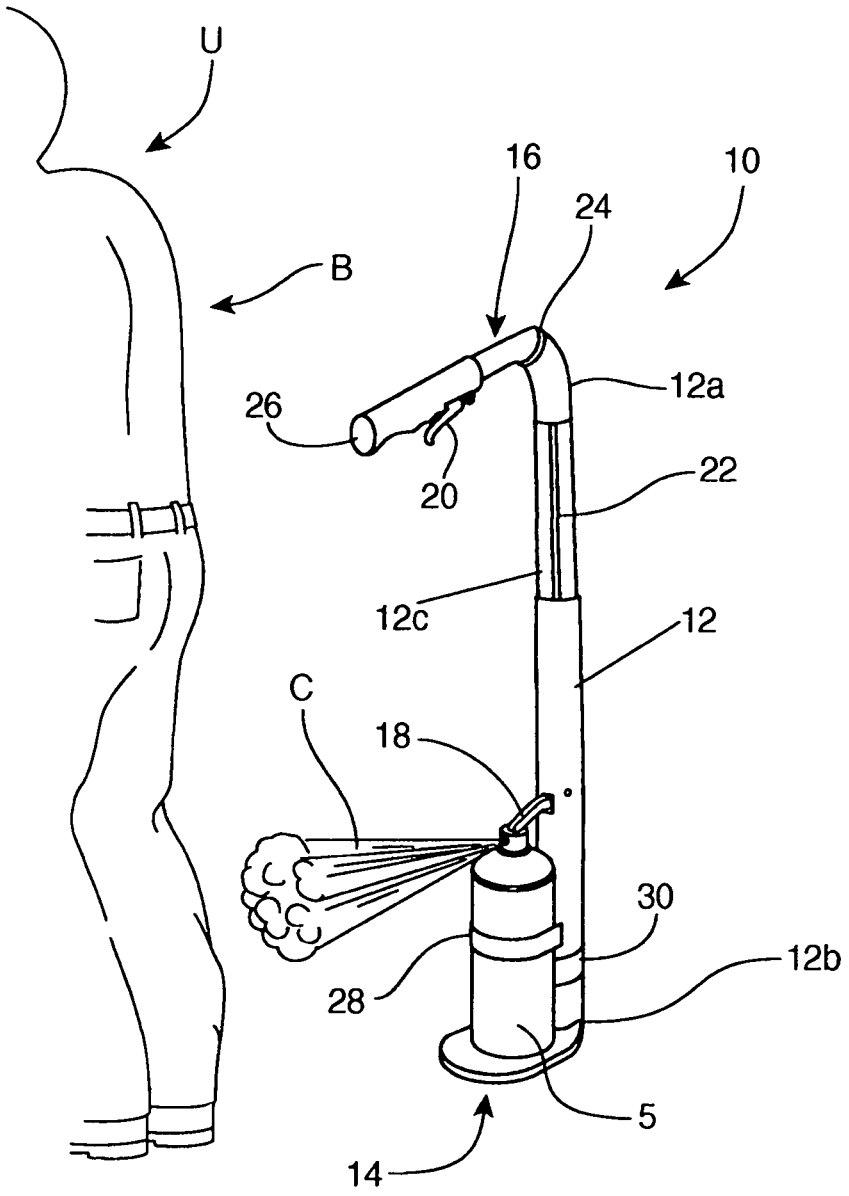
FIG. 1 is a perspective view of a first and second locking device made in accordance with the present invention showing the first locking device in its retracted position and the second locking device in its closed position.
Figure 2:
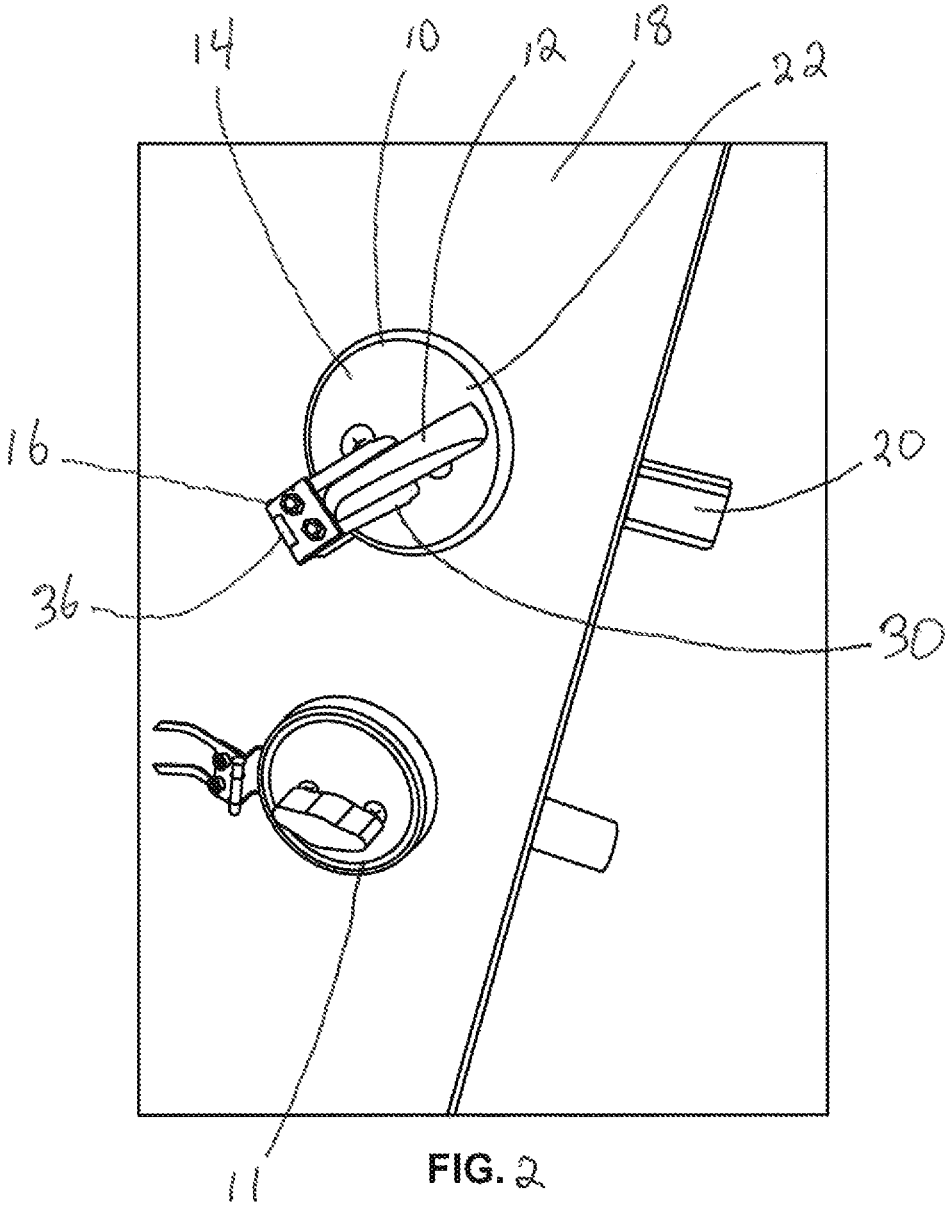
FIG. 2 is a perspective view of the pair of locking devices shown in FIG. 1 showing the first locking device in its closed position and the second locking device in its retracted position.
Figure 3:
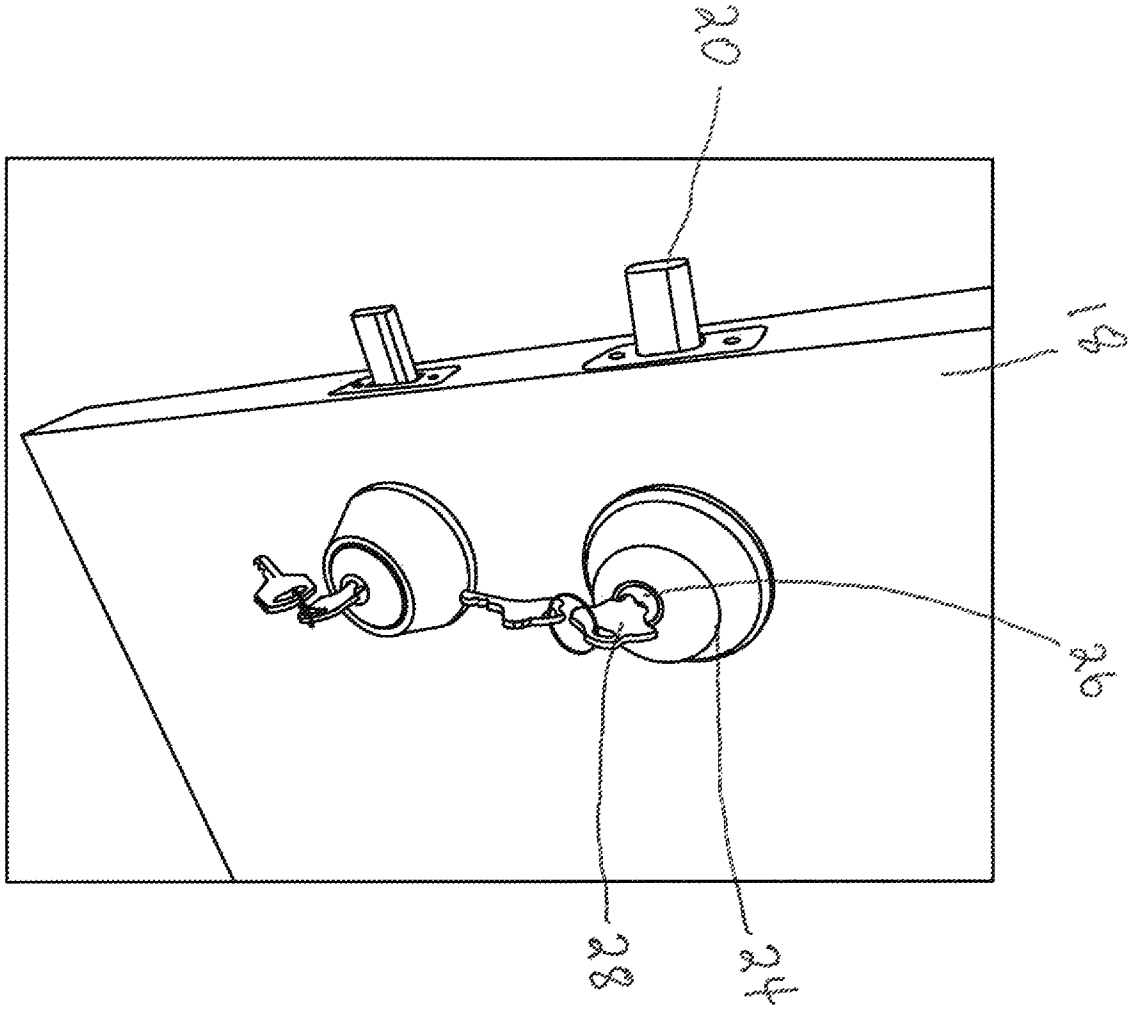
FIG. 3 is a perspective view of the first and second locking devices shown in FIG. 1 showing the keyhole side of the first and second locking devices.

Referring to FIGS. 1 and 2, a pair of locking devices each made in accordance with the present invention is shown generally as items 10 and 11. Locking device 10 and 11 are both identical in every way, with the only difference being in the orientation of the latch 12, with the latch of lock device 12 being oriented horizontally when the latch is in its locked position while in lock device 11 the latch is at an angle from the horizontal when the latch is in its locked position. For the purposes of this disclosure, both locking devices will be discussed with reference to device 10 only. Locking device 10 is made from a standard deadbolt lock 14 which is mounted to door 18. Deadbolt lock 14 is a standard deadbolt lock of the type having an elongated latch 12 which is rotated between locked and unlocked positions, a deadbolt housing having a latch cover 22 and a keyhole cover 24 (see FIG. 3) and a bolt 20 which is movable between an extended position as shown in FIG. 1 and a retracted position wherein the bolt is retracted into the door (see FIG. 4). The standard deadbolt lock 14 will have a lock mechanism within the deadbolt housing which is configured to couple bolt 20 to latch 12 and keyhole barrel 26 allowing the latch and the keyhole barrel to move the bolt between its retracted and extended positions. Standard deadbolt locks suitable for use with the present invention are readily available in the marketplace and routinely sold in retail hardware stores.

Figure 5:
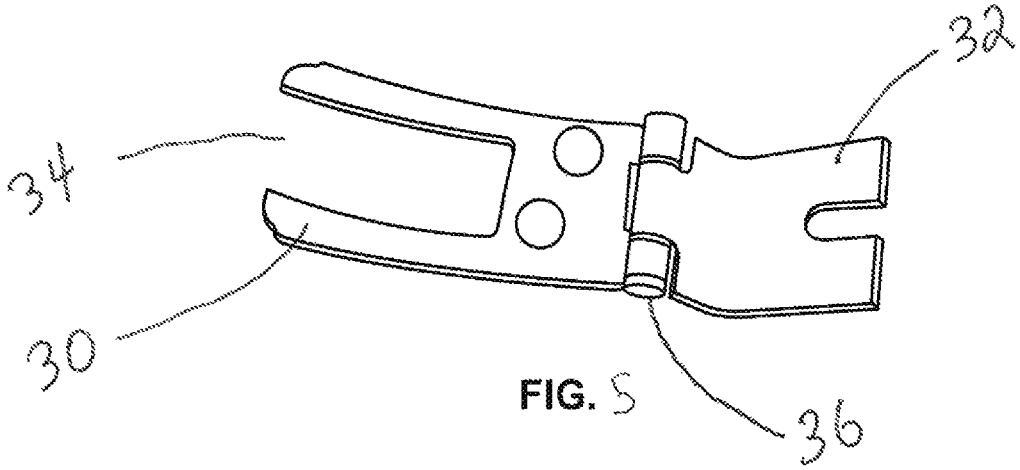
FIG. 5 is a perspective view of the latch securing assembly portion of the present invention.
Figure 6:
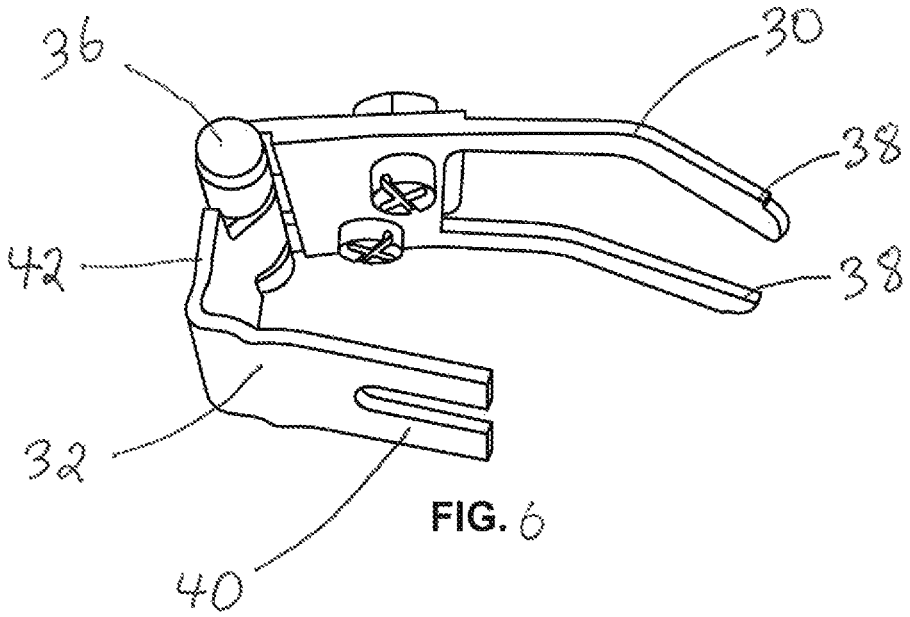
FIG. 6 is a perspective view of the latch securing assembly shown in FIG. 5 showing the elongated portion in its closed position.
Figure 7:
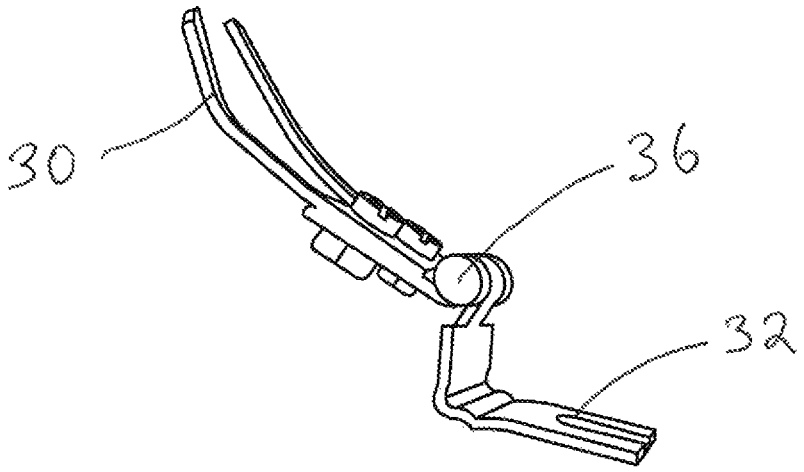
FIG. 7 is a perspective view of the latch securing assembly shown in FIG. 5 showing the elongated portion in its retracted position.

Referring to FIG. 1, the locking device of the present invention further includes a latch securing assembly 16 which is selectively movable between a retracted state as shown in FIG. 1 and a closed state as shown in FIG. 2. As best seen in FIG. 2, latch securing assembly 16 consists of a base portion 32 which is securely mounted to latch cover 22 of the deadbolt housing and elongated portion 30. Elongated portion 30 preferably consists of a pair of fingers which are separated by an elongated groove 34. Elongated groove 34 is dimensioned and configured to receive and retain latch 12 such that when elongated portion 30 is in its closed position (see FIG. 1) the latch is retained in the elongated groove and the latch cannot be rotated. As best seen in FIGS. 5, 6 and 7, base portion 32 preferably takes the form of an L shaped bracket. As best seen in FIG. 6, base portion 32 has a footer portion 40 and a neck portion 42 which is approximately perpendicular to the footer portion. A pivot joint 36 couples base portion 32 to elongated portion 30. Preferably, pivot joint 36 is a ratcheting type joint which is configured to hold elongated portion 30 at an angle to base portion 32 unless the elongated portion is forcibly moved. Alternatively, joint 36 could simply be a joint having a friction bushing made of brass or plastic which helps to keep elongated portion 30 at an angle to base portion 32 unless the elongated portion is forcibly moved from one position into another. Elongated portion 30 consists of a pair of finders having terminal ends 38. Preferably terminal ends 38 are curved downwardly such that they are inclined towards footer portion 40 when the elongated portion is positioned perpendicular to neck portion 42. When attached to the deadbolt 14 (see FIG. 2), the terminal ends of the fingers will be oriented towards the deadbolt lock. The downwardly oriented finger ends ensures good contact with the latch of the deadbolt lock which in turn prevents inadvertent rotation of the latch when the locking device is in its closed orientation.

Figure 4:
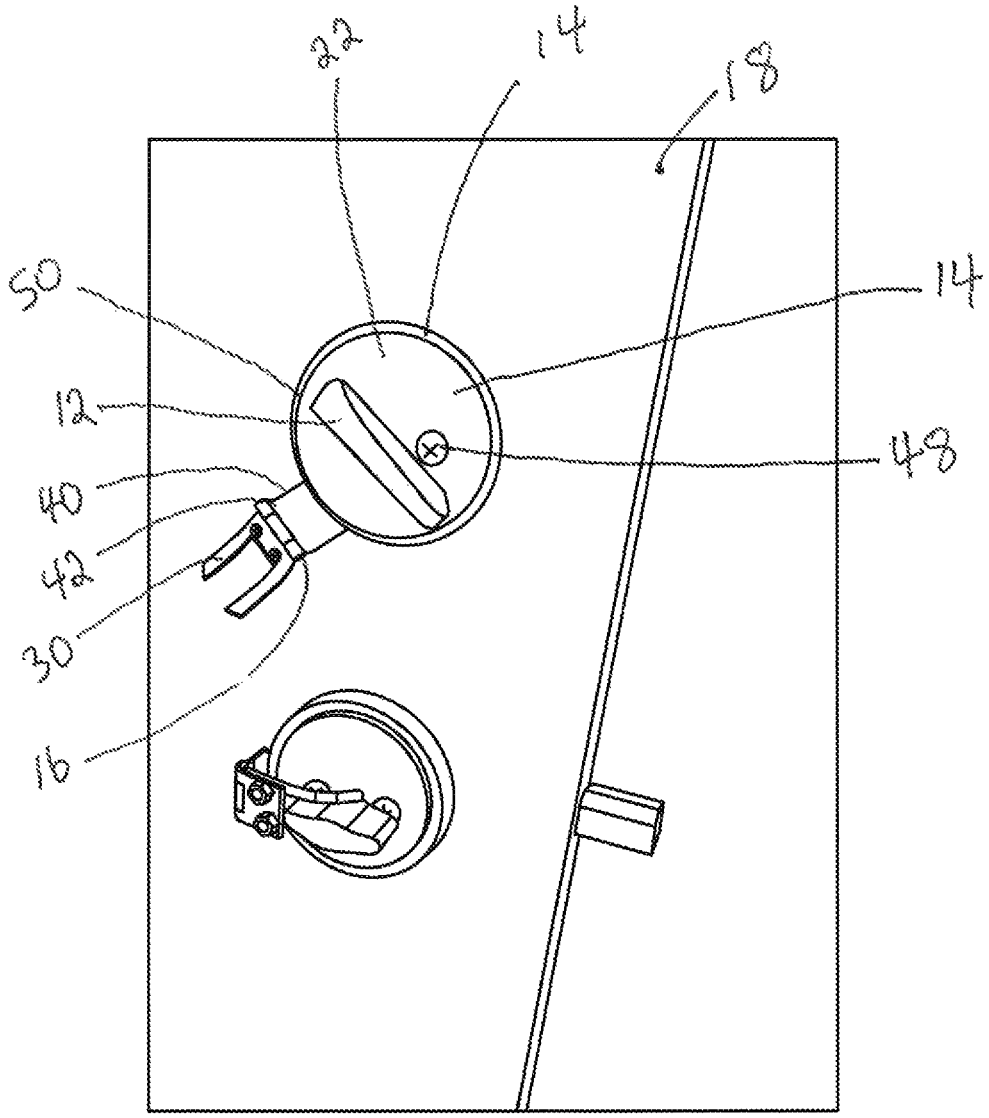
FIG. 4 is a perspective view of the present invention showing the first locking device in its retracted position and showing the latch in its unlocked position, FIG. 4 also showing the second locking device in its closed position with the latch in its locked position.

As can be seen in FIG. 4, assembly 16 is mounted to the deadbolt lock 14. The deadbolt lock has a latch cover 22 which is the part of the deadbolt housing which partially contains the deadbolt lock mechanism which is coupled to the deadbolt latch 12. Assembly 16 is secured to deadbolt lock 14 by positioning a portion of footer 40 under rim 50 of latch face 22 and then forcing face 22 towards door 18 by means of bolts 48. It will be appreciated that like most standard deadbolt locks, deadbolt lock 14 is secured to door 18 by means of bolts 48 which pass through latch cover 22 and engage on to keyhole cover 24 (see FIG. 3). Turning bolts 48 presses rim 50 against door 18 which in turn clamps footer 40 into position. Alternatively, assembly 16 could be mounted to deadbolt lock 14 by bolting or welding the assembly directly onto latch cover 22.

Referring back to FIG. 1, assembly 16 is mounted to deadbolt lock 14 such that aperture 34 is aligned with latch 12 when the latch is in its locked position, corresponding to bolt 20 being in its extended position. This permits the user to secure latch 12 by flipping elongated portion 30 from its extended position as shown in FIG. 1, to its closed position as shown in FIG. 2. When the elongated portion is in its closed position, latch 12 is secured and cannot be rotated. With the latch being secured, it is not possible to unlock deadbolt lock 14 by turning the key on the other side of the door. To unlock the door, elongated member 30 is flipped into its extended position and the latch is turned into its unlocked position as shown in FIG. 4, which causes the bolt to retract into the door thereby unlocking the door.

The present invention is very easy to construct as it simply consists of a base member, an elongated member and a pivot joint linking the two together. The base member and elongated member can be made very inexpensively from stamped steel, while the joint can be formed by curving adjacent edges on the base member and elongated member and linking the two with a metal pin. The metal pin can have ratchets formed thereon to provide the joint with a means to hold the two members at an angle to each other, or a plastic or brass bushing can be added to the joint to achieve the same function. The device is also is very easy to install onto an existing deadbolt lock installation by simply loosening the latch cover of the deadbolt clamp, inserting the footer portion between the door and the rim of the latch cover and then tightening the latch cover again to clamp the footer between the door and the rim of the latch cover. The device is very easy to use, simply requiring the user to flip the elongated member. Since the latch securing assembly can be mounted anywhere around the latch cover, it is possible to position the assembly where it will not interfere with the operation of the door when the door is opened or closed. The latch is also very securely retained by the assembly because the latch is firmly retained within a the aperture formed in the elongated member which is dimensioned and configured to snuggly retain the latch.

Therefore, what is claimed is:

1. A combination comprising:

a deadbolt lock assembly comprising a lock housing, a bolt slidingly received in said lock housing, a latch rotatably mounted to said lock housing and movable between a locked position and an unlocked position, and a locking mechanism coupled to said latch and said bolt which moves said bolt between an extended position and a retracted position in response to rotation of said latch;

a securing device which releasably secures said latch in said locked position, said device comprising: a base portion operatively connected to said lock assembly; an elongated portion adapted to engage said latch; and a hinge mechanism which allows pivotal movement of said base and elongated portions with respect to each other;

said elongated portion comprising a pair of substantially parallel fingers separated by an elongated groove which can receive said latch therein; each of said fingers having a first end attached to said hinge mechanism and a terminal free end unconnected to any other structure and terminating in a tip spaced furthest from said hinge mechanism said terminal free end tip having a curvature towards said lock assembly when said latch is within said groove between said fingers, said free end tip curvature ensuring good contact with said lock assembly base portion to prevent inadvertent rotation of said latch; and wherein said securing device consists of said base portion, elongated portion, and hinge mechanism and wherein said elongated portion consists of said fingers.

2. The combination as recited in claim 1 wherein said hinge mechanism provides a consistent biasing force to retain said elongated portion both in a first position wherein said latch is received in said groove between said fingers, and a second position wherein said latch is not received in said groove between said fingers.

3. The combination as recited in claim 2 wherein said biasing force is provided by a friction bushing component of said hinge mechanism.

4. The combination as recited in claim 1 wherein said base portion includes a footer portion which operatively connects to said lock assembly, and a neck portion approximately perpendicular to said footer portion, said neck portion operatively connected to said hinge mechanism.

5. The combination as recited in claim 2 wherein said base portion includes a footer portion which operatively connects to said lock assembly, and a neck portion approximately perpendicular to said footer portion, said neck portion operatively connected to said hinge mechanism.

6. A combination comprising:

a deadbolt lock assembly comprising a lock housing, a bolt slidingly received in said lock housing, a latch rotatably mounted to said lock housing and movable between a locked position and an unlocked position, and a locking mechanism coupled to said latch and said bolt which moves said bolt between an extending position and a retracted position in response to rotation of said latch;

a securing device which releasably secures said latch in said locked position, said device comprising: a base portion operatively connected to said lock assembly; an elongated portion adapted to engage said latch; and a hinge mechanism which allows pivotal movement of said base and elongated portions with respect to each other;

said elongated portion comprising a pair of substantially parallel fingers separated by an elongated groove which can receive said latch therein, each of said fingers having a first end attached to said hinge mechanism and a terminal free end unconnected to any other structure and terminating in a tip spaced furthest from said hinge mechanism;

wherein said hinge mechanism provides a consistent biasing force to retain said elongated portion both in a first position wherein said latch is received in said groove between said fingers, and a second position wherein said latch is not received in said groove between said fingers; and wherein said biasing force is provided by a friction bushing component of said hinge mechanism, and wherein said securing device consists of said base portion, elongated portion, and hinge mechanism; and wherein said elongated portion consists of said fingers.

7. The combination as recited in claim 6 wherein said securing device consists of said base portion, elongated portion, and hinge mechanism.

8. The combination as recited in claim 6 wherein said base portion includes a footer portion which operatively connects to said lock assembly, and a neck portion approximately perpendicular to said footer portion, said neck portion operatively connected to said hinge mechanism.

9. The combination as recited in claim 7 wherein said base portion includes a footer portion which operatively connects to said lock assembly, and a neck portion approximately perpendicular to said footer portion, said neck portion operatively connected to said hinge mechanism.

10. A securing device moveable between first and second positions operatively engaging or releasing, respectively, a rotatable dead bolt latch, said device consisting of:

a base portion; an elongated portion adapted to engage a dead bolt latch; and a hinge mechanism which allows pivotal movement of said base and elongated portions with respect to each other;

said elongated portion consisting of a pair of substantially parallel fingers separated by an elongated groove which can receive a deadbolt latch therein in said first position, each of said fingers having a first end attached to said hinge mechanism and a terminal free end unconnected to any other structure and terminating in a tip spaced furthest from said hinge mechanism.

11. A securing device as recited in claim 10 wherein said terminal free ends of said finger tips have a curvature towards and contacting said base portion when said device is in said first position.

12. A securing device as recited in claim 10 wherein said hinge mechanism provides a consistent biasing force to retain said elongated portion in both said first and second positions.

13. A securing device as recited in claim 12 wherein said biasing force is provided by a friction bushing component of said hinge mechanism.

14. A securing device as recited in claim 10 wherein said base portion includes a footer portion and a neck portion approximately perpendicular to said footer portion, said neck portion operatively connected to said hinge mechanism.

15. A securing device as recited in claim 12 wherein said terminal free ends of said finger tips have a curvature towards said base portion when said device is in said first position.

16. A securing device as recited in claim 15 wherein said base portion includes a footer portion and a neck portion approximately perpendicular to said footer portion, said neck portion operatively connected to said hinge mechanism.

* * * * *